US011655606B2

(12) United States Patent
Vankeirsbilck

(10) Patent No.: US 11,655,606 B2
(45) **Date of Patent: *May 23, 2023**

(54) SOIL-DISPLACEMENT DRILL, METHOD FOR CONVERTING A SOIL-DISPLACEMENT DRILL AND METHOD FOR FORMING A FOUNDATION PILE

(71) Applicant: OLIVIER INDUSTRIE NV, Rumbeke (BE)

(72) Inventor: Gerdi Vankeirsbilck, Rumbeke (BE)

(73) Assignee: OLIVIER INDUSTRIE NV, Rumbeke (BE)

( * ) Notice: Subject to any disclaimer, the term of this patent is extended or adjusted under 35 U.S.C. 154(b) by 0 days.

This patent is subject to a terminal disclaimer.

(21) Appl. No.: 17/571,282

(22) Filed: Jan. 7, 2022

(65) Prior Publication Data

US 2022/0127809 A1 Apr. 28, 2022

Related U.S. Application Data

(63) Continuation of application No. 16/757,750, filed as application No. PCT/IB2018/055710 on Jul. 31, 2018, now Pat. No. 11,268,255.

(30) Foreign Application Priority Data

Oct. 20, 2017 (BE) ..... 2017/5752

(51) Int. Cl.
*E02D 5/38* (2006.01)
*E02D 5/72* (2006.01)
*E02D 15/04* (2006.01)

(52) U.S. Cl.
CPC ..... *E02D 5/385* (2013.01); *E02D 5/72* (2013.01); *E02D 15/04* (2013.01);
(Continued)

(58) Field of Classification Search
CPC ..... E02D 5/38; E02D 5/385; E02D 5/665; E02D 5/72; E02D 7/22; E02D 15/04
(Continued)

(56) References Cited

U.S. PATENT DOCUMENTS 779,880 A * 1/1905 Shuman ..... E02D 5/385
405/242
2,576,507 A * 11/1951 Gerwick, Jr. ..... E02D 5/665
175/318

(Continued)

FOREIGN PATENT DOCUMENTS

DE 9002781 7/1991
DE 10310727 A1 * 10/2004 ..... E02D 3/08

(Continued)

OTHER PUBLICATIONS

Search Report for International Patent Application PCT/IB2018/055710, dated Apr. 25, 2019.

*Primary Examiner* — Frederick L Lagman
(74) *Attorney, Agent, or Firm* — Fresh IP PLC; Clifford D. Hyra; Aubrey Y. Chen

(57) ABSTRACT

Disclosed herein is a soil-displacement drill for soil-displacing drilling in a surface in order to form a foundation pile, comprising a drill pipe, a drill head at an end of the drill pipe with several flap leaves which are pivotable between a closed position for closing off the end of the drill pipe and an open position for making this end freely accessible, and one or several closing elements to keep these flap leaves in their closed position and prevent pivoting of the flap leaves which are configured to fail during drilling into the surface in such a way that these closing elements do not impede pivoting of the flap leaves. Additionally, disclosed herein is an assembly of a drill head and one or several closing elements for such a soil-displacement drill, a method for soil-displacing drilling, and a method for converting a soil-displacement drill to form such a soil-displacement drill.

16 Claims, 6 Drawing Sheets

(52) U.S. Cl.
CPC ..... *E02D 2200/1685* (2013.01); *E02D 2250/0007* (2013.01); *E02D 2250/0023* (2013.01); *E02D 2250/0038* (2013.01); *E02D 2300/002* (2013.01); *E02D 2300/0029* (2013.01)

(58) Field of Classification Search
USPC ..... 405/233, 239, 240, 241, 243
See application file for complete search history.

(56) References Cited

U.S. PATENT DOCUMENTS

| | | | | |
|---|---|---|---|---|
| 3,830,072 | A * | 8/1974 | Visconti | E02D 5/665 405/243 |
| 4,126,007 | A * | 11/1978 | Mars | E02D 3/08 405/271 |
| 6,592,300 | B2 * | 7/2003 | Yang | E02D 5/385 405/253 |
| 6,672,408 | B2 * | 1/2004 | Frantz | E02D 9/02 175/69 |
| 9,816,245 | B2 * | 11/2017 | Reinhardt | E02D 5/36 |
| 11,268,255 | B2 * | 3/2022 | Vankeirsbilck | E02D 5/385 |
| 2003/0021637 | A1 | 1/2003 | Yang | |
| 2013/0177359 | A1 * | 7/2013 | Hamata | E02D 15/04 405/240 |

FOREIGN PATENT DOCUMENTS

| | | | | |
|---|---|---|---|---|
| DE | 10351956 | B3 * | 7/2005 | E02D 5/38 |
| WO | WO-9316236 | A1 * | 8/1993 | E02D 5/385 |

* cited by examiner

10

A B C D

SOIL-DISPLACEMENT DRILL, METHOD FOR CONVERTING A SOIL-DISPLACEMENT DRILL AND METHOD FOR FORMING A FOUNDATION PILE

This application is a continuation of U.S. patent application Ser. No. 16/757,750, filed Apr. 4, 2020, now U.S. Pat. No. 11,268,255, which is a National Phase entry of International Application No. PCT/IB2018/055710 under § 371 and claims the benefit of Belgian Patent Application No. BE-2017/5752, filed Oct. 20, 2017, each of which is incorporated by reference in its respective entirety.

FIELD OF THE DISCLOSURE

The present disclosure relates to a soil-displacement drill for soil-displacing drilling in a surface in order to form a foundation pile, comprising:

a drill pipe; and a drill head which is attached to one end of the drill pipe and comprises several flap leaves which are arranged so as to be pivotable between a closed position for closing off the end of the drill pipe and an open position for at least partly making the end of the drill pipe freely accessible.

The present disclosure also relates to a method for converting a soil-displacement drill for soil-displacing drilling in a surface in order to form a foundation pile, which comprises a drill pipe and comprises a drill head, which is attached to one end of the drill pipe, wherein the drill head of the drill pipe is removed and a new drill head is attached to the end of the drill pipe which comprises several flap leaves which are arranged so as to be able to pivot between a closed position for closing off the end of the drill pipe and an open position, for at least partly making the end of the drill pipe freely accessible.

In addition, the present disclosure relates to a method for forming a foundation pile by means of such a soil-displacement drill.

BACKGROUND

Soil-displacement drills which are typically being used in practice for forming a foundation pile comprise a drill pipe made of metal with a lost drill tip at the bottom. This drill pipe is screwed into the surface by means of the lost tip, as a result of which the soil is displaced laterally. Subsequently, reinforcement is arranged in the drill pipe, if desired, and the drill pipe is filled with filling material, such as for example concrete. The drill pipe is withdrawn from the surface again, in which case the optional reinforcement and the filling material remain behind in the surface to form the foundation pile. The drill tip also remains behind in the surface, possibly without having any further function. In this way, such a foundation pile may be arranged vertically or at an angle in the surface.

The popularity of soil-displacement drills is still rising and they are being used more and more all over the world. In built-up areas, drilling is preferred to pile-driving, vibrating or pressing, as drilling causes fewer vibrations which are detrimental to the built-up areas and causes less noise pollution.

However, the use of lost drill tips with such soil-displacement drills has a number of drawbacks.

In Belgium alone, approximately 100,000 piles are installed annually by means of such a soil-displacement drill, and in each case a lost drill tip is used to prevent soil and water from ending up in the drill pipe. The most common lost drill tips are made of cast iron or steel. Currently, such a lost drill tip costs between €15 and €25. At an average price of €20, the figure spent on lost drill tips in the Belgian market is approximately €2,000,000.

These drill tips have to be loaded after production, have to be transported via the road and unloaded and distributed on the site.

Positioning the drill tip with respect to the drill pipe is laborious and risky. Workers regularly have their fingers trapped between the lost drill tip and the drill pipe.

During drilling, lost drill tips also tilt away regularly as a result of an obstacle in the surface.

In order to overcome the abovementioned drawbacks, attempts have already been made to develop soil-displacement drills without such a lost drill tip or with a more limited lost drill tip.

NL 2 005 298 C and NL 9 100 258 A describe and show soil-displacement drills according to the introductory part of the first claim. The attempts to overcome said drawbacks use a drill head which is fixedly attached to the drill pipe and is provided with pivotable flap leaves in order to make the end of the drill pipe freely accessible in order to pull it out of the surface after drilling. In most of the embodiments described herein, the flap leaves end in a point. NL 9 100 258 A also describes an embodiment in which the flap leaves form a truncated cone, on which an even smaller lost drill tip is placed.

However, in order to be able to open and close the flap leaves, each of the drill heads is provided with a complicated mechanism. The components thereof can quickly become damaged during drilling and during formation of the foundation piles when these components come into contact with soil and concrete.

In addition, with the embodiments without a lost drill tip soil is inevitably scooped up into the drill pipe during closing of the flaps when drilling starts. Soil in the drill pipe is disadvantageous to forming a good foundation pile. The drill pipe may become clogged, so that the optional reinforcement and the filling material for forming the foundation pile will become stuck during drilling out. If loose soil still comes out of the drill pipe, this soil is at the bottom of the pile base, resulting in a badly executed foundation pile.

With the embodiment having a smaller lost drill tip, the costs of the material of the lost drill tip are limited. However, the problems of positioning the drill tip and tilting away remain.

In practice, the solutions from NL 2 005 298 C and NL 9 100 258 A are therefore not used.

SUMMARY

It is an object of embodiments of the present invention to provide a solution for the abovementioned drawbacks.

This object may firstly be achieved by providing a soil-displacement drill for soil-displacing drilling in a surface in order to form a foundation pile, comprising:

a drill pipe;

a drill head which is attached to one end of the drill pipe and comprises several flap leaves which are arranged so as to be pivotable between a closed position for closing off the end of the drill pipe and an open position for at least partly making the end of the drill pipe freely accessible; and one or several closing elements which are attachable to the outside of the flap leaves in order to keep these flap leaves in their closed position and to prevent the flap leaves from pivoting and which are configured to fail during drilling of the soil-displacement drill into the surface in such a way that these closing elements do not impede pivoting of the flap leaves.

Due to the fact that the drill head is attached to the drill pipe, the abovementioned problems of lost drill tips are overcome. The cost price of the lost drill tip no longer has to be considered. Precious steel is not wasted unnecessarily. Loading, transportation, unloading and distribution of the drill tips is obsolete. The risk of accidents is greatly reduced, as positioning of the drill head can be performed very easily and accurately due to the fact that it forms a single part with the drill pipe. As a result thereof, the risk of the drill tip tilting away is also gone.

Due to the closing elements, the flap leaves are kept closed in a simple manner. To this end, these closing elements may be attached to this drill head at any aboveground position of the drill head. It is thus possible to choose an ergonomically favourable position, which also affords a good view of the drill head. Attaching these closing elements is not associated with the same risks as attaching a lost drill tip, which always has to be positioned on the surface with respect to the drill head.

The closing elements also keep the flap leaves closed at the start of drilling, so that no soil is scooped up, as is the case with the soil-displacement drills without drill tip from NL 2 005 298 C and NL 9 100 258 A. Keeping these flap leaves closed is particularly crucial at the start of drilling into the surface. Once the drill head is in the surface, the flap leaves automatically remain closed during deeper drilling.

When the closing elements fail, the flap leaves thus still remain closed during further drilling. During drilling, these closing elements will fail in such a manner that they do not block the flap leaves from opening again when the soil-displacement drill has been screwed out of the surface. Opening of these flap leaves can easily be effected on account of the filling material and the optional reinforcement when the soil-displacement drill is being pulled up. To this end, the closing elements do not necessarily have to completely fail. It suffices if they fail to such a degree that they do not impede opening again of the flap leaves. Therefore, a complicated mechanism for opening and closing these flap leaves is no longer required.

In this case, the closing elements may be configured to fail due to wear and/or due to breaking and/or due to cracking.

In the attached position, the closing elements preferably clamp the flap leaves shut in their closed position.

The solution according to embodiments of the present disclosure can be used both for forming smooth foundation piles and for forming helical foundation piles, or still other forms of piles, such as for example rectangular piles, square piles, hexagonal, octagonal, etc.

The drill head may take different forms.

Preferably, this ends away from the drill pipe in a tip and is designed so as to taper towards this tip. In their attached position, the one or several closing elements preferably leave this tip free in order to influence the effect of the drilling in the failing of these closing elements as little as possible.

More specifically, this drill head is preferably at least partly conical or bit-shaped, viewed in the closed position of the flap leaves. The drill head may, for example, conically adjoin said tip.

The flap leaves may form this drill head together, in which case they may each be attached to the drill pipe separately. In addition to the flap leaves, the drill head may, for example, also comprise an annular mounting (wall element) which is attached to the drill pipe and to which the flap leaves are attached. The flap leaves may be of a shell-shaped design.

On the outside, the drill head may be provided with spirals or wear parts or hardfacing and/or additional drill tips.

In their closed positions the flap leaves preferably extend entirely next to each other, without overlapping one another.

The drill pipe preferably comprises a substantially circular cross section. This may be virtually completely cylindrical, but may, for example, also comprise a widening, such as for example a widening in the form of a so-called displacer. On its outside and/or inside, the drill pipe may be provided with spirals. This drill pipe may be designed as a single-part or a multipart drill pipe.

At said end of the drill pipe, the latter is preferably cut off substantially straight and has an end face which is virtually perpendicular to the direction of drilling. Optionally, it may in this case be provided with further said cams which project with respect to this end face.

Depending on the type of drill, it may rotate in the same direction when being drilled into the surface and in the opposite direction when being drilled out of the surface.

The drill head comprises several flap leaves. In its simplest form, it only comprises two of said flap leaves.

In a simple embodiment, a soil-displacement drill according to the present disclosure comprises only one said closing element which is configured to keep all flap leaves in their closed position.

Preferably, this closing element is then at least partly annular. Preferably, the annular part thereof is then configured to clamp around all flap leaves in the attached position of the closing element.

In order to accelerate the failing of the one or several closing elements during drilling, each closing element is preferably provided with one or several weakened sections. The closing element will then wear, crack and/or break more quickly at the location of such a weakened section. Such weakened sections may be achieved in a large number of ways. The closing elements may, for example, be made relatively thin locally. These weakened sections may, for example, also be formed by providing one or several recesses in each closing element.

Alternatively or additionally, each closing element may be provided with one or several engagement elements in order for the surface to engage thereon while drilling the soil-displacement drill into the surface in order to accelerate the failing thereof. By means of such an engagement element, forces which the surface exerts on the closing element can be passed to a tip or zone where the closing element can wear, crack and/or break more quickly on account of these forces.

In an advantageous embodiment, one single closing element is provided which comprises an annular base body, wherein one or several of said engagement elements are raised with respect to this base body and delimit one or several of said recesses. In this case, the annular base body is preferably configured to hold the flap leaves together by clamping.

In this case, the closing element is preferably substantially cylindrical, in which case incisions are provided in one end of this cylindrical shape which delimit engagement elements. These incisions are preferably substantially triangular.

The closing element is then preferably substantially crown-shaped.

In a preferred embodiment, a soil-displacement drill according to the present disclosure comprises a drill tip which is attachable to or forms part of the flap leaves, away from the end of the drill pipe. This drill tip is then provided on the side of the drill head opposite the side by means of which it is attached to the drill pipe. Such a drill tip simplifies positioning the soil-displacement drill for drilling it into a surface still further.

More specifically, each flap leaf may comprise a drill tip part to this end, wherein these drill tip parts together then form this drill tip in the closed position of the flap leaves.

Such a drill tip preferably comprises a cylindrical base body, over which a said annular part of an at least partly annular closing element is arrangeable in order to attach the closing element to the flap leaves. Preferably, this annular part is then arranged over this cylindrical base body in a clamping manner.

The one or several closing elements of a soil-displacement drill according to embodiments of the present disclosure are preferably made of plastic. These may be rigid or elastic.

In their open position, the flap leaves preferably extend substantially inside the smallest surrounding cylinder of the drill pipe, so that these, during drilling out of the drill pipe, impede the drilling out of the drill pipe and the passing through of the filling material and optional reinforcement as little as possible. Still more preferably, these flap leaves extend virtually as a continuation of the drill pipe in this case.

The access to the drill pipe is thus opened completely in the open position of the flap leaves.

The flap leaves are preferably arranged in the soil-displacement drill by means of hinges which are arranged in such a way that they extend within the envelope of the drill pipe and/or the flap leaves when these flap leaves are in their closed position.

By arranging the hinges in this way, these hinges are less susceptible to damage by soil and/or filling material and form no obstacle when drilling the soil-displacement drill into and out of the surface.

To this end, the drill pipe may comprise a drill pipe wall within which—viewed in the closed position of the flap leaves—these hinges are at least partly arranged. The hinges are preferably completely arranged inside the wall of the drill pipe and/or the extension thereof. In order to accommodate the hinges at least partly in the drill pipe wall and/or the extension thereof, it preferably has a wall thickness of at least 2 cm.

Instead of accommodating the hinges at least partly in the drill pipe wall itself, the drill head may alternatively comprise an annular wall section within which the hinges—viewed in the closed position of the flap leaves—are at least partly arranged. Alternatively or additionally, the hinges may extend at least partly inside the flap leaves in the closed position of the flap leaves.

In the closed position of the flap leaves, the hinges then preferably extend substantially inside the pipe wall and/or inside the annular wall section and/or inside the flap leaves.

In a specific embodiment, spaces are provided in the drill pipe wall, which end at the end of the drill pipe, the hinges extending at least partly in these spaces.

Alternatively, the flap leaves may be provided with spaces inside which the hinges at least partly extend.

The soil-displacement drill furthermore comprises preferably one or several cams which are provided at the end of the drill pipe or on an annular wall section of the drill head to which the flap leaves are hingedly attached. Each flap leaf then preferably comprises at least one corresponding recess for at least partly accommodating a said cam herein, so that the flap leaves are arranged on the one or several cams in a secured manner in their closed position. By means of these cams, the load on the hinges is reduced significantly.

In a particularly robust embodiment, every two mutually adjacent flap leaves are secured on the same said cam in their closed position at the location where they adjoin.

An object of the present disclosure is also achieved by providing an assembly of a drill head for a soil-displacement drill for soil-displacing drilling in a surface and one or several closing elements, wherein the drill head comprises several flap leaves which are arranged to as to be able to pivot between a closed position and an open position and wherein the one or several closing elements are attachable to the outside of the flap leaves in order to keep these flap leaves in their closed position and prevent the flap leaves from pivoting and are configured to fail during drilling of the soil-displacement drill into the surface in such a manner that these closing elements do not impede pivoting of the flap leaves.

An object of the present disclosure is furthermore also achieved by providing a method for converting a soil-displacement drill for soil-displacing drilling in a surface in order to form a foundation pile which comprises a drill pipe and comprises a drill head which is attached to one end of the drill pipe, wherein the drill head of the drill pipe is removed and a new drill head is attached to the end of the drill pipe which comprises several flap leaves which are arranged so as to be able to pivot between a closed position for closing off the end of the drill pipe and an open position for at least partly making the end of the drill pipe freely accessible, wherein the soil-displacement drill is provided with one or several closing elements which are attachable to the outside of at least two of said flap leaves in order to keep these flap leaves in their closed position and to prevent the flap leaves from pivoting and which are configured to fail during drilling of the soil-displacement drill into the surface in such a way that these closing elements do not impede pivoting of the flap leaves.

Preferably, an above-described soil-displacement drill according to the present disclosure is then formed with such a method according to the present disclosure.

Lastly, an object of the present disclosure is also achieved by providing a method for forming a foundation pile by means of a soil-displacement drill which comprises a drill pipe and a drill head which is attached to an end of the drill pipe and comprises several flap leaves which are arranged so as to be able to pivot between a closed position for closing off the end of the drill pipe and an open position for at least partly making the end of the drill pipe freely accessible, in which, in the following order:

- the flap leaves are taken to their closed position and one or several closing elements are attached to the outside of the flap leaves to keep the flap leaves in their closed position and to prevent the flap leaves from pivoting while the drill is taken to a distance from the surface;
- the drill is lowered and the drill is disposed on a surface with the flap leaves in their closed position;
- the drill is drilled into the surface, in which case the one or several closing elements are configured to fail in such a way during the drilling of the drill into the surface that these closing elements do not impede the flap leaves from pivoting;
- material for forming the foundation pile is arranged in the drill pipe; and the drill pipe is pulled up with the flap leaves in their open position.

Preferably, an above-described soil-displacement drill according to the present disclosure is then used with such a method according to the present disclosure.

BRIEF DESCRIPTION OF THE DRAWINGS

Embodiments of the present disclosure will now be explained in more detail by means of the following description of a preferred soil-displacement drill. The sole aim of this description is to give purely illustrative examples and to indicate further advantages and particulars of embodiments of the disclosure, and can therefore by no means be interpreted as a limitation of the area of application of the invention or of the patent rights defined in the claims.

In this description, reference numerals are used to refer to the attached drawings, in which.

DETAILED DESCRIPTION

Figure 1:
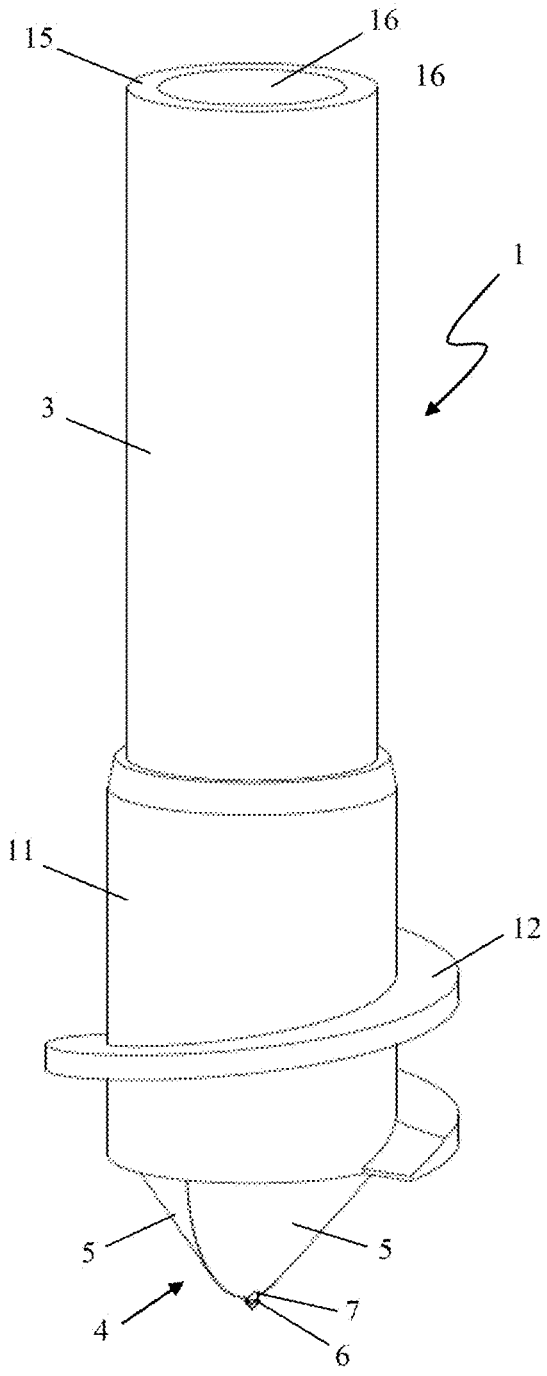
FIG. 1 shows the bottom part of a soil-displacement drill according to at least one embodiment of the present disclosure with a part of its drill pipe, its drill head and its closing element in perspective, with the drill head in a closed position.

The illustrated soil-displacement drills (1) comprise a drill pipe (3), a drill head (4) attached thereto and a closing element (6).

In the illustrated embodiments, the drill pipe (3) is substantially cylindrical and is provided with a displacer (11) at the bottom which is formed as a widening of the drill pipe (3). In the illustrated embodiments, at the location of this displacer (11), the drill pipe (3) is provided with a spiral (12) on its outside. Alternatively or additionally, the drill pipe (3) may be provided with one or several external spirals along its entire length. In alternative embodiments, the drill pipe (3) may also be provided without said displacer (11) and/or without spirals.

A cylindrical space (16) extends through the entire drill pipe (3). In specific embodiments, this cylindrical space (16) may be provided with one or several internal spirals.

This drill pipe (3) may, for example, be made of metal.

Figure 2:
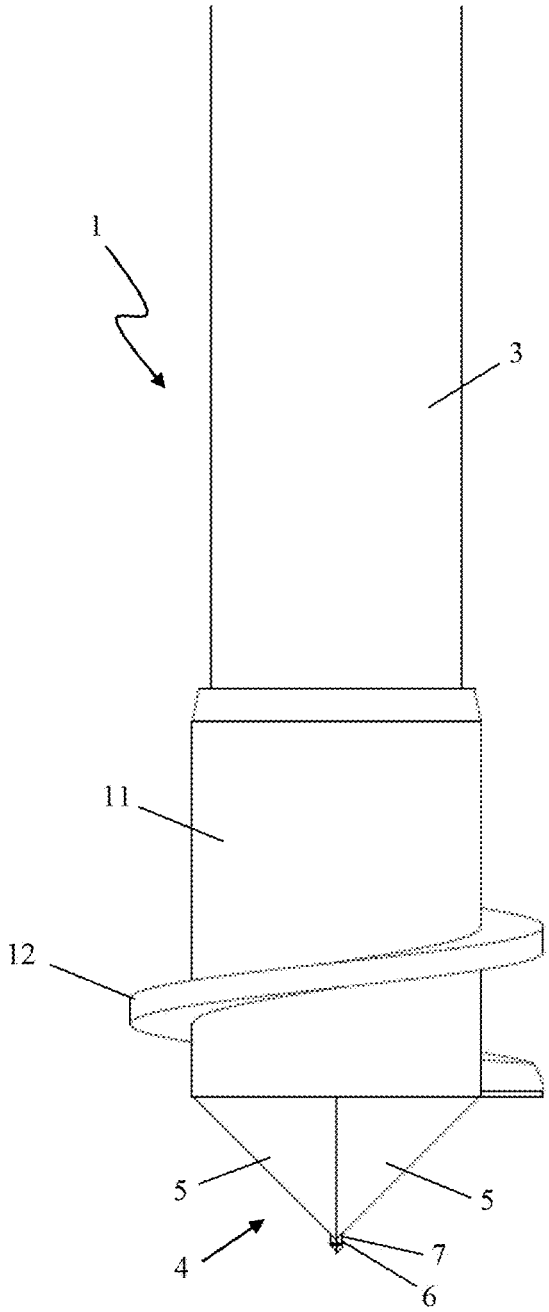
FIG. 2 shows the part of the soil-displacement drill from FIG. 1 in a front view with the drill head in a closed position.

In the embodiment in FIGS. 1 and 2, the drill pipe (3) is cut off straight at the bottom end of the drill pipe (3) where the drill head (4) is attached, and has an end face which is virtually perpendicular to the direction of drilling. In the embodiment in FIGS. 3-9, cams (22) project with respect to this end face.

The illustrated drill heads (4) in each case comprise two flap leaves (5). In alternative embodiments, a drill head (4) may also be provided with several flap leaves (5).

Figure 6:
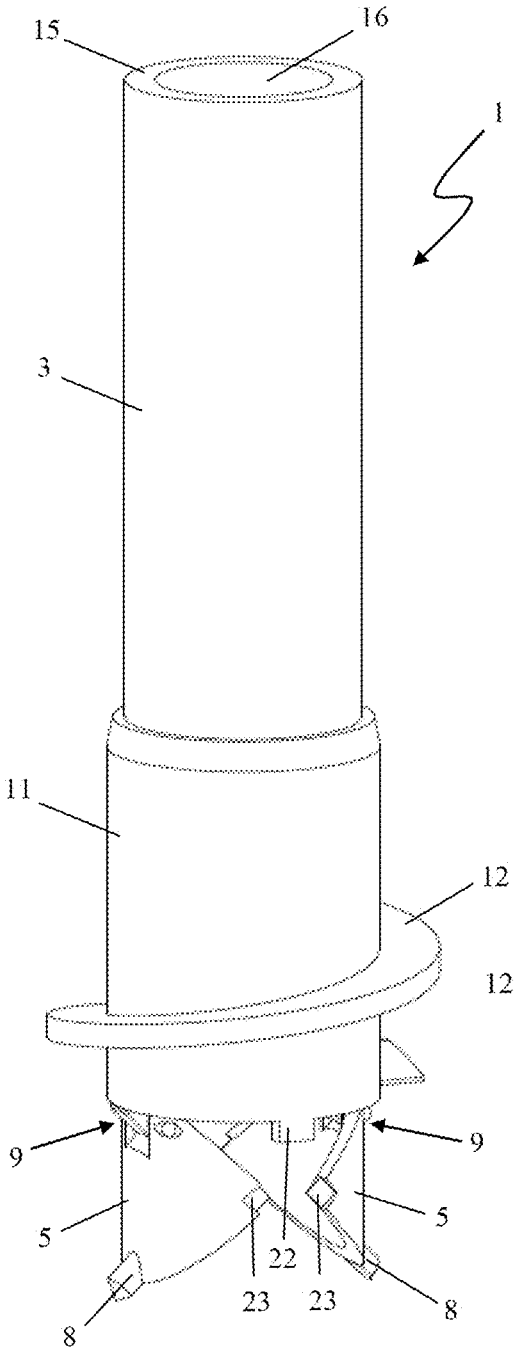
FIG. 6 shows a bottom part of the soil-displacement drill from FIG. 3 in perspective, with the closing element worn away and the drill head in an open position.
Figure 7:
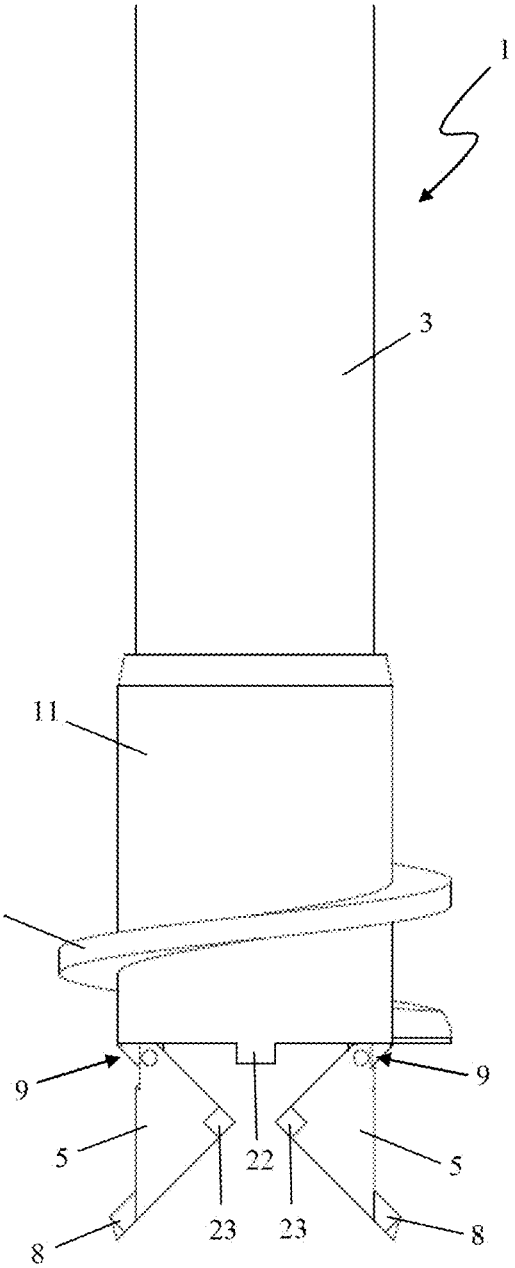
FIG. 7 shows the part of the soil-displacement drill from FIG. 6 in a front view, with the closing element worn away and the drill head in an open position.
Figure 8:
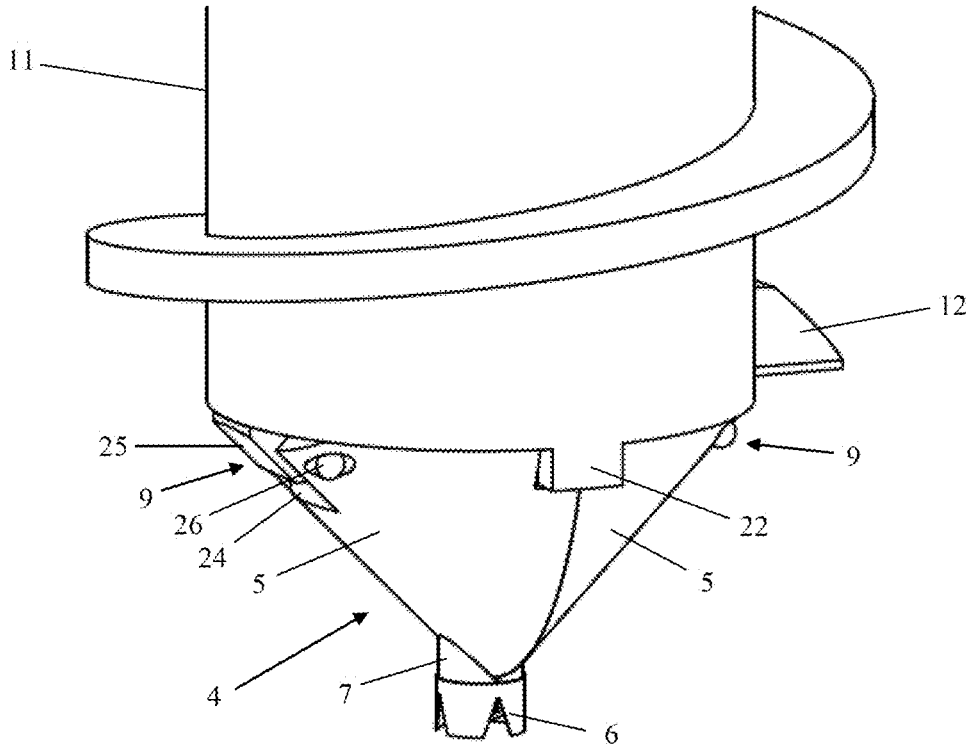
FIG. 8 shows a part of the soil-displacement drill from FIG. 3 at the location of the drill head in more detail in perspective, with the drill head in a closed position.
Figure 9:
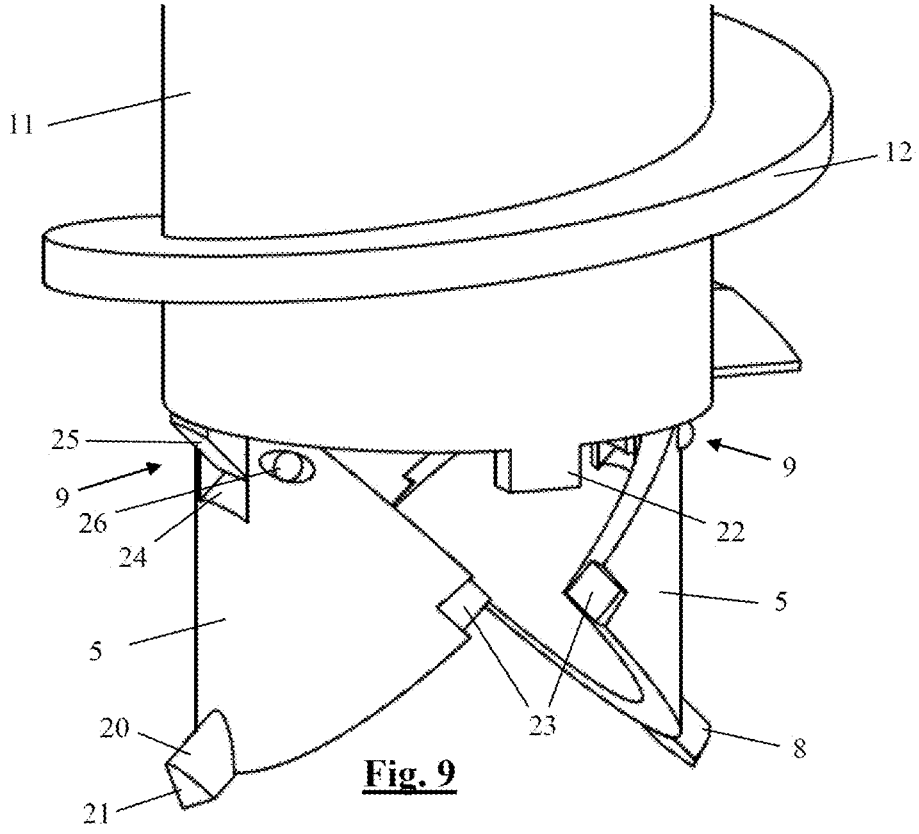
FIG. 9 shows a part of the soil-displacement drill from FIG. 3 at the location of the drill head in more detail in perspective, with the closing element worn away and the drill head in an open position.

The flap leaves (5) are arranged so as to be able to pivot between a closed position, for closing off the bottom end of the drill pipe (3), as illustrated in FIGS. 1-4 and 8, and an open position, for at least partly making this end of the drill pipe (3) freely accessible, as illustrated in FIGS. 6, 7 and 9. To this end, each flap leaf (5) is hingedly attached to the drill pipe (3) by means of a hinge (9).

In the embodiment in FIGS. 1-2, this hinge (9) extends substantially inside a space in the pipe wall (15) of the drill pipe (3) in the closed position of the flap leaf (5). To this end, this pipe wall (15) is made sufficiently wide at the location of the displacer (11) in order to provide these spaces for the hidden hinges (9) which end at the said end of the drill pipe (3).

In the embodiment in FIGS. 3-9, this hinge (9) extends substantially inside a space (24) in the flap leaf (5) in the closed position of the flap leaf (5). To this end, an attachment body (25) is provided at the bottom of the displacer (11) for each flap leaf (5) and is arranged within the width of the pipe wall (15) of the displacer (11) and is bevelled in order to be able to extend substantially inside the space (24) in the flap leaf (5) in the closed position. A hinge pin (26) is arranged through this attachment body (25) and in the flap leaf (5) in order to attach this flap leaf (5) to this attachment body (25) so as to be able to pivot about this hinge pin (26).

In the second embodiment, the flap leaves (5) are also provided with recesses (23) which correspond to the aforementioned cams (22) in such a way that the flap leaves (5), in their closed position, are secured with respect to these cams (22), this at the location where the flap leaves (5) adjoin each other.

The drill head (4) tapers away from the drill pipe (3). In this case, the illustrated flap leaves (5) are of a shell-shaped design and together, in their closed position, form a substantially bit-shaped drill head (4). In this case, these flap leaves (5) preferably extend completely next to each other, without overlapping one another.

In their open position, these flap leaves (5) extend substantially inside the smallest surrounding cylinder of the drill pipe (3).

In the illustrated embodiment, each flap leaf (5) is provided with a drill tip part (8) away from the drill pipe (3). In the closed position of the flap leaves (5), the drill tip parts (8) of both flap leaves (5) together form a drill tip (7). This drill tip (7) comprises a cylindrical base body (20) over which the closing element (6) is arrangeable in a clamping manner, and a conical tip (21).

In the first embodiment, the closing element (6) is of annular design and made from plastic. To this end, this closing element (6) may be rigid or elastic.

Figure 3:
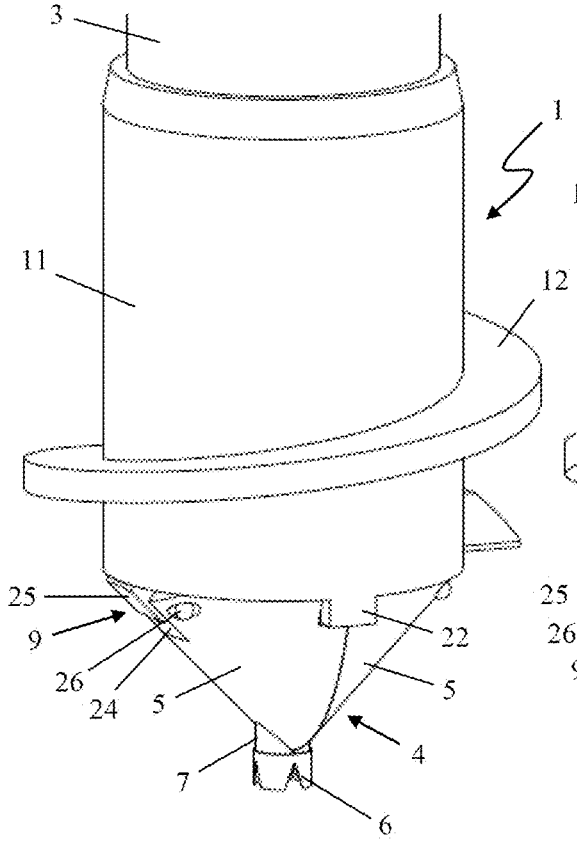
FIG. 3 shows the bottom part of an alternative soil-displacement drill according to at least one embodiment of the present disclosure with a part of its drill pipe, its drill head and its closing element in perspective, with the drill head in a closed position.
Figure 4:
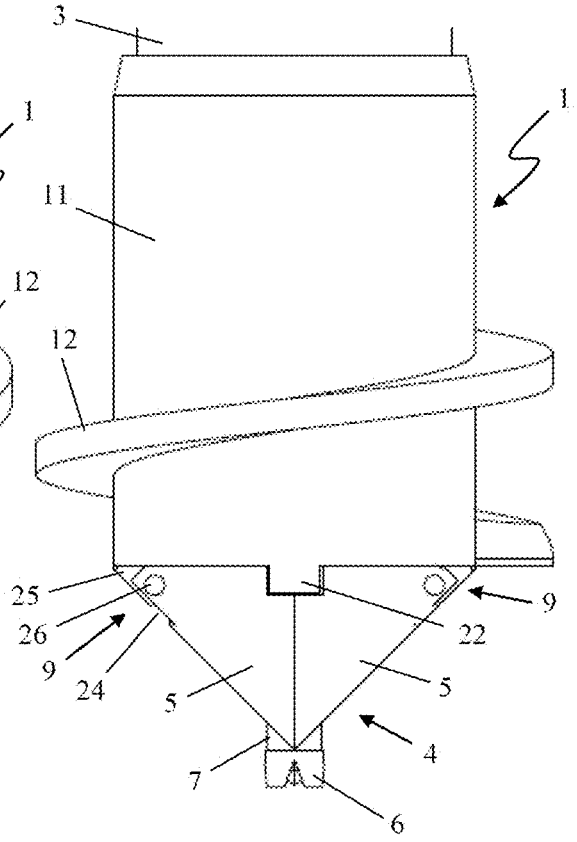
FIG. 4 shows the part of the soil-displacement drill from FIG. 3 in a front view, with the drill head in a closed position.
Figure 5:
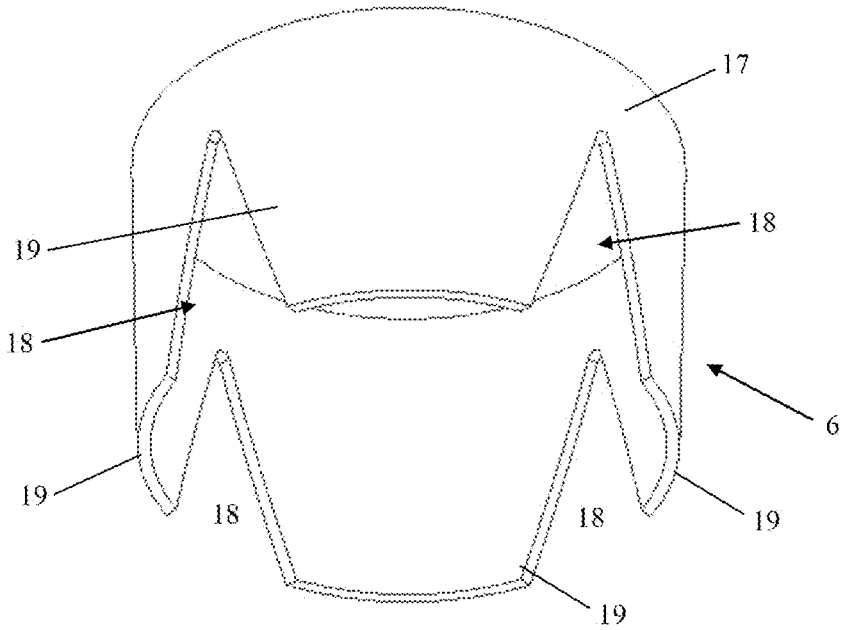
FIG. 5 shows the closing element from FIGS. 3 and 4 separately in perspective.

In the second embodiment, the closing element (6) comprises an annular base body (17) and four engagement elements (19) which are raised with respect to this base body (17). To this end, this closing element (6) is substantially cylindrical and comprises four virtually triangular incisions (18) which delimit the said engagement elements (19). By means of the annular base body (17), this closing element (6) is clamped around the cylindrical base body (20) of the drill tip (7), as can be seen in FIGS. 3, 4 and 8. In this case, the engagement elements (19) project downwards, so that the surface (10) engages with these engagement elements (19) when drilling in a surface (10) in order to break and/or crack the annular base body (17) at the location of the incisions (18). To this end, this closing element (6) is preferably made of plastic by means of injection-moulding.

A drill head (4), such as for example an illustrated drill head (4), and a closing element (6), such as for example an illustrated closing element (6), may together also form a said assembly according to the present disclosure by means of which an existing soil-displacement drill can be modified to form a soil-displacement drill (1) according to the present disclosure.

To this end, the existing drill head of this existing soil-displacement drill may be removed and replaced by this new drill head (4). The closing element (6) may be provided on the outside of the flap leaves (5) of this new drill head (4) in order to keep these flap leaves (5) in their closed position.

Figure 10A:
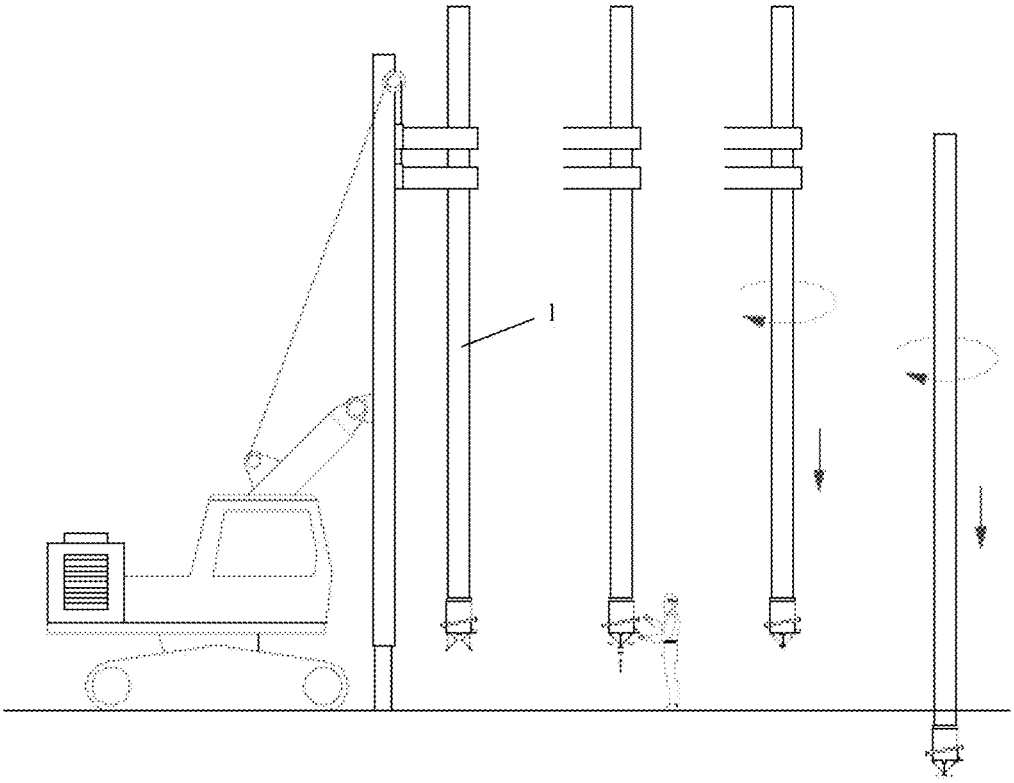
FIGS. 10*a* and 10*b* diagrammatically show in several steps how a foundation pile can be formed in a surface by means of a soil-displacement drill according to at least one embodiment of the present disclosure.
Figure 10B:
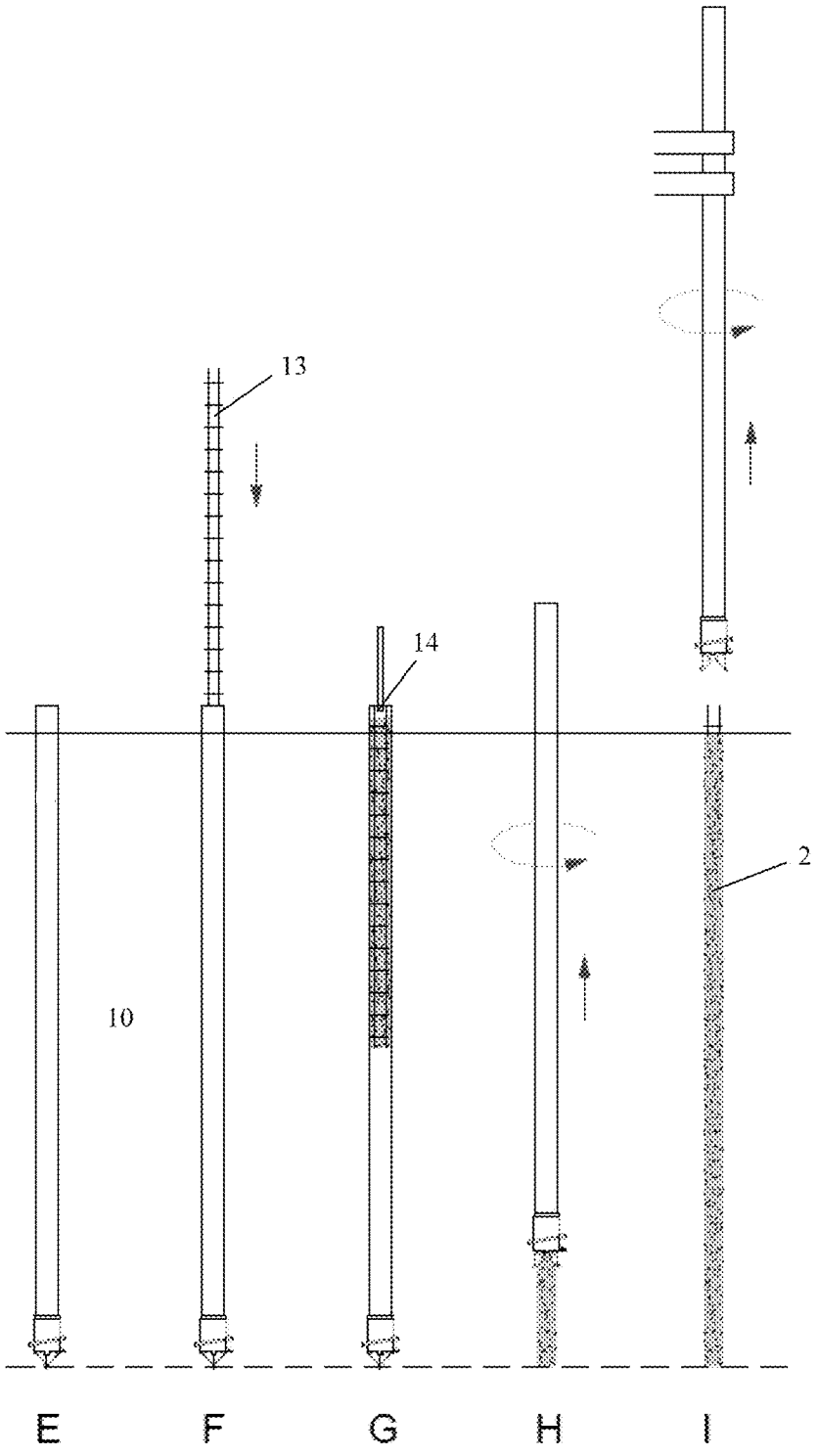

FIGS. 10*a* and 10*b* show how drilling in a surface (10) can take place by means of a soil-displacement drill (1) according to the present disclosure in order to form a foundation pile (2). The drill pipe (3) and the drill head (4), with the flap leaves (5) in their open position, are first lifted up (step A) to a height at which the flap leaves (5) can be closed easily and the closing element (6) can be fitted (step B). Thanks to the closing element (6), the flap leaves (5) in this soil-displacement drill (1) according to the present disclosure are easily held together when using it to drill in the surface (10) (step C). The drill (1) is lowered and drilled into the surface (10) (step D). When the drill head (4) is in the surface (10), the flap leaves (5) automatically remain closed during drilling to a deeper level. If the closing element (6) fails completely, the flap leaves (5) thus remain closed when drilling continues. The surface (10) is displaced laterally until the drill pipe (3) is situated in the surface (10) virtually completely (step E). Then, reinforcement (13) is introduced into the drill pipe (3) (step F) and the drill pipe (3) is filled with filling material (14) (step G), such as for example concrete. The closing element (6) is configured in such a way that this closing element (6), even if it does not fail completely, does not impede the flap leaves (5) from opening again when the soil-displacement drill (1) is drilled out of the soil again. Opening these flap leaves (5) may be effected in a simple manner on account of the filling material (14) and the reinforcement (13) when the soil-displacement drill (1) is lifted up. The drill pipe (3) is pulled out of the surface (10) (step H), with the reinforcement (13) and the filling material (14) remaining behind in the surface (10) to form the foundation pile (2) (step I).

What is claimed is:

1. An assembly comprising:

a drill head; and one or several closing elements, wherein the drill head comprises a plurality of flap leaves which are arranged so as to be able to pivot between a closed position and an open position, and wherein the one or several closing elements are attachable to the outside of at least two of the plurality of flap leaves in order to keep the at least two flap leaves in the closed position and to prevent the at least two flap leaves from pivoting and are configured to fail during drilling of the soil-displacement drill into a surface in such a manner that the one or several closing elements do not impede pivoting of the at least two flap leaves, wherein each closing element comprises one or several weakened sections in order to cause the closing element to fail more quickly during drilling, and wherein each closing element comprises one or several recesses to form the one or several weakened sections.

2. The assembly of claim 1, wherein the assembly comprises only one closing element, wherein the one closing element is configured to keep all of the plurality of flap leaves in the closed position, and wherein the one closing element is at least partly annular.

3. The assembly of claim 1, wherein each flap leaf in the plurality of flap leaves comprises a drill tip part, wherein the drill tip parts together form the drill tip in the closed position of the plurality of flap leaves.

4. The assembly of claim 1, wherein each closing element comprises one or several engagement elements in order for the surface to engage thereon while drilling the soil-displacement drill into the surface in order to accelerate the failing of each closing element.

5. The assembly of claim 4, wherein each closing element comprises an annular base body and in that the one or several said engagement elements are raised with respect to the base body and delimit the one or several recesses.

6. The assembly of claim 5, wherein the soil-displacement drill further comprises a drill tip that is attachable to, or forms part of, the plurality of flap leaves, wherein the drill tip comprises a cylindrical base body, over which the annular part of each closing element is arrangeable in order to attach each closing element to the plurality of flap leaves.

7. A soil-displacement drill comprising:

a drill pipe; and an assembly comprising a drill head and one or several closing elements, wherein the drill head comprises a plurality of flap leaves which are arranged so as to be able to pivot between a closed position and an open position, and wherein the one or several closing elements are attachable to the outside of at least two of the plurality of flap leaves in order to keep the at least two flap leaves in the closed position and to prevent the at least two flap leaves from pivoting and are configured to fail during drilling of the soil-displacement drill into a surface in such a manner that the one or several closing elements do not impede pivoting of the at least two flap leaves, and one or several projections which are provided at the end of the drill pipe or on an annular wall section of the drill head, wherein each of the plurality of flap leaves comprises at least one corresponding recess, so that the flap leaves are arranged on the one or several projections in a secured manner in the closed position, and wherein the drill head of the assembly is attached to one end of the drill pipe and the plurality of flap leaves of the drill head are arranged for closing off the end of the drill pipe in the closed position and for at least partly making the end of the drill pipe freely accessible in the open position.

8. The soil-displacement drill of claim 7, wherein each of the one or several closing elements comprises one or several recesses that form one or several weakened sections.

9. The soil-displacement drill of claim 7, wherein each of the one or several closing elements comprises one or several engagement elements in order for the surface to engage thereon while drilling the soil-displacement drill into the surface in order to accelerate the failing of each closing element.

10. The soil-displacement drill of claim 9, wherein each of the one or several closing elements comprises an annular base body, and wherein the one or several engagement elements are raised with respect to the annular base body.

11. The soil-displacement drill of claim 10, further comprising a drill tip that is attachable to, or forms part of, the plurality of flap leaves, away from the end of the drill pipe, wherein the drill tip comprises a cylindrical base body, over which the annular part of each closing element is arrangeable in order to attach the closing element to the plurality of flap leaves.

12. The soil-displacement drill of claim 7, wherein every two mutually adjoining flap leaves are secured on the same projection in the closed position at the location where they adjoin.

13. A method for forming a foundation pile, the method comprising:

using a soil-displacement drill comprising a drill pipe and a drill head that is attached to one end of the drill pipe, wherein the drill pipe comprises a plurality of flap leaves that are arranged so as to be pivotable between a closed position for closing off the one end of the drill pipe and an open position for at least partly making the one end of the drill pipe freely accessible, wherein the soil-displacement drill is further provided with one or several closing elements that are attachable to an outside of at least two of the plurality of flap leaves in order to keep the at least two flap leaves in the closed position and to prevent the at least two flap leaves from pivoting, wherein the one or several closing elements are configured to fail during drilling of the soil-displacement drill into a surface in such a way that the one or several closing elements do not impede pivoting of the plurality of flap leaves, and wherein each of the one or several closing elements comprises one or several recesses that form one or several weakened sections.

14. The method of claim 13, wherein each of the one or several closing elements comprises one or several engagement elements in order for the surface to engage thereon while drilling the soil-displacement drill into the surface in order to accelerate the failing of the one or several closing elements.

15. A soil-displacement drill comprising:

a drill pipe; and an assembly comprising a drill head and one or several closing elements, wherein the drill head comprises a plurality of flap leaves which are arranged so as to be able to pivot between a closed position and an open position, and wherein the one or several closing elements are attachable to the outside of at least two of the plurality of flap leaves in order to keep the at least two flap leaves in the closed position and to prevent the at least two flap leaves from pivoting and are configured to fail during drilling of the soil-displacement drill into a surface in such a manner that the one or several closing elements do not impede pivoting of the at least two flap leaves, wherein the drill head of the assembly is attached to one end of the drill pipe and the plurality of flap leaves of the drill head are arranged for closing off the end of the drill pipe in the closed position and for at least partly making the end of the drill pipe freely accessible in the open position, and wherein each of the one or several closing elements comprises one or several recesses that form one or several weakened sections.

16. A soil-displacement drill comprising:

a drill pipe;

an assembly comprising a drill head and one or several closing elements, wherein the drill head comprises a plurality of flap leaves which are arranged so as to be able to pivot between a closed position and an open position, and wherein the one or several closing elements are attachable to the outside of at least two of the plurality of flap leaves in order to keep the at least two flap leaves in the closed position and to prevent the at least two flap leaves from pivoting and are configured to fail during drilling of the soil-displacement drill into a surface in such a manner that the one or several closing elements do not impede pivoting of the at least two flap leaves; and a drill tip that is attachable to, or forms part of, the plurality of flap leaves, away from the end of the drill pipe, wherein the drill head of the assembly is attached to one end of the drill pipe and the plurality of flap leaves of the drill head are arranged for closing off the end of the drill pipe in the closed position and for at least partly making the end of the drill pipe freely accessible in the open position, wherein each of the one or several closing elements comprises one or several engagement elements in order for the surface to engage thereon while drilling the soil-displacement drill into the surface in order to accelerate the failing of each closing element, wherein each of the one or several closing elements comprises an annular base body, and wherein the one or several engagement elements are raised with respect to the annular base body, wherein the drill tip comprises a cylindrical base body, over which the annular part of each closing element is arrangeable in order to attach the closing element to the plurality of flap leaves.

* * * * *